United States Patent [19]

Gibson et al.

[11] Patent Number: 4,756,170

[45] Date of Patent: Jul. 12, 1988

[54] APPLICATOR FOR CREASE-SETTING COMPOSITION

[75] Inventors: James D. M. Gibson, Ilkley; Paul Hageman, Bradford, both of United Kingdom; Soichiro Kishida, Kyoto, Japan; Yasuyuki Nishimura, Shimotoyoura, Japan; Katsutoshi Aida, Nakamura Minami, Japan; Tatsuro Yamada, Kodaira, Japan; Jyo Narumiya, Sayama, Japan

[73] Assignees: Wool Development International Limited, Ilkley, United Kingdom; DYNIC Corporation, Tokyo, Japan

[21] Appl. No.: 721,590

[22] Filed: Apr. 10, 1985

[30] Foreign Application Priority Data

Apr. 17, 1984 [GB] United Kingdom ..... 8409942

[51] Int. Cl.[4] ..... D06B 1/04

[52] U.S. Cl. ..... 68/200; 493/328; 493/395; 493/450; 223/30; 118/44; 118/410

[58] Field of Search ..... 68/200; 118/44, 410; 223/29, 30, 31, 34, 35; 112/121.4; 72/389; 57/32; 493/328, 395, 396, 397, 402, 404, 405, 418, 419, 438, 450, 454, 455, 476

[56] References Cited

U.S. PATENT DOCUMENTS

| | | | |
|---|---|---|---|
| 1,196,956 | 9/1916 | Kellener | 493/402 |
| 1,228,689 | 6/1917 | Miller | 68/200 |
| 1,943,443 | 1/1934 | Kilham | 118/44 X |
| 2,744,563 | 5/1956 | Mennerich | 68/200 U X |
| 3,073,000 | 1/1963 | Gonsalves et al. | 68/200 U X |
| 3,154,228 | 10/1964 | Klint, Jr. | 223/30 X |
| 3,224,309 | 12/1965 | Nash | 118/44 X |
| 3,258,943 | 7/1966 | Claiborne | 68/200 X |
| 3,790,157 | 2/1974 | Crawford et al. | 493/418 X |
| 3,960,487 | 6/1976 | Stritzko | 68/183 X |
| 4,036,414 | 7/1977 | Miranda | 223/28 |
| 4,170,347 | 10/1979 | Lewis | 493/450 X |
| 4,183,233 | 1/1980 | Brown | 68/201 X |
| 4,191,793 | 3/1980 | Gibson et al. | 223/28 X |
| 4,264,993 | 5/1981 | Freeman et al. | 68/201 X |
| 4,444,101 | 4/1984 | Weiner et al. | 118/44 X |

FOREIGN PATENT DOCUMENTS

| | | | |
|---|---|---|---|
| 57-139567 | 8/1982 | Japan | 223/28 |
| 709804 | 6/1954 | United Kingdom | 494/418 |
| 1580192 | 11/1980 | United Kingdom . | |

*Primary Examiner*—Harvey C. Hornsby

*Attorney, Agent, or Firm*—Henry Sternberg; Bert J. Lewen

[57] ABSTRACT

An apparatus for applying a crease-setting composition for setting a crease in textile material in which the composition is forced out of a nozzle at a controlled delivery rate while the nozzle is guided along the crease line.

15 Claims, 3 Drawing Sheets

APPLICATOR FOR CREASE-SETTING COMPOSITION

This invention relates to an applicator, particularly for the formation of durable creases by application of a crease-setting composition.

In order to form durable creases in a textile article, for example in trousers or slacks, a setting composition may be introduced into the formed creases, for example according to UK Pat. No. 1603252 or European published application No. 67528. The creases are made durable by curing the composition. In these specifications, the applicator is operated by hand, and has a nozzle on one end of a cylinder. The composition filling the cylinder is compressed by a piston within the cylinder, and is forced through the nozzle. The piston is moved by the rotation of a rotary member mounted on the lower portion of the other end of the cylinder in response to movement along the crease line.

These applicators, especially that of the above European publication, give excellent results in service. There is one area, however, where there is room for improvement. When trousers made of very light weight material are to be treated the normal creasing composition cannot be employed since its viscosity is such that, although perfectly satisfactory for normal-to-heavy-weight materials, it can 'strike-through' to the front surface of light weight materials. Thus a different crease setting composition, or resin, has to be employed which will not 'strike-through'. Such a resin is available but has a higher viscosity than the normally used composition. This means that more effort is needed to expel it through the nozzle. Since the driving force is obtained by pressure of a rotary member on the fabric of the trousers, this can cause the fabric to ruck-up or otherwise distort, thereby destroying the precision necessary to produce an accurate crease line.

This invention seeks to provide an improved applicator for use with light weight fabrics which overcomes or reduces the above problems.

According to the present invention there is provided an applicator for crease-setting composition which comprises an applicator body having at one end thereof a nozzle for applying the crease-setting composition into a crease line and at the other end thereof an inlet for compressed air for forcing the composition out of the nozzle, and guidance means mounted beneath the body adapted, in use to depend into the crease line so as to guide the applicator nozzle to cause it to deliver composition accurately into the crease.

The guidance means preferably comprises a fin-like guide plate of a length corresponding to a substantial proportion of the body; and of a width form or shape, at its lower edge, corresponding to the requirements of the crease being treated, provided on the lower side of the applicator body, one end of which is equipped with a nozzle through which the composition is forced, and the other end with a tube supplying compressed air for forcing out the composition. The guide plate may be set on the axial line passing through the nozzle in the longitudinal direction of the applicator body so that it accurately guides the applicator and nozzle in relation to the crease line.

In one embodiment of the invention, the applicator is mounted for automatic operation above a v-grooved conveyor for carrying garment panels, e.g. skirt panels or trouser panels, past the applicator. The latter is carried, preferably on pneumatic cylinders, so that it can be raised and lowered from and to its work station allowing the insertion of fresh panels to be treated. Advantageously the application of air pressure to expel composition through the nozzle is in timed relationship with the movement of the conveyor carrying the panels past the nozzle. Several advantages accrue from this arrangement: rapid operation, less operator skill necessary, accurate location of crease and setting composition and therefore improved quality and durability of the resultant treated panels.

The invention will be described further, by way of example, with reference to the accompanying drawings, in which.

Figure 1:
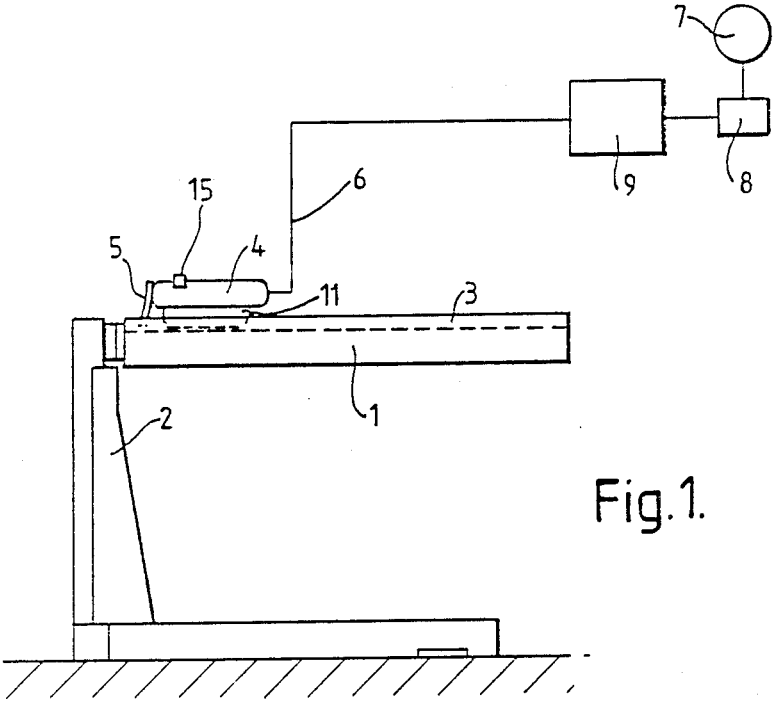
FIG. 1 is a side elevation of an applicator in accordance with the invention in operation.
Figure 2:
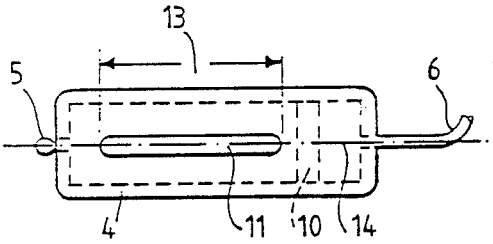
FIG. 2 is a bottom plan view of the applicator alone.
Figure 3:
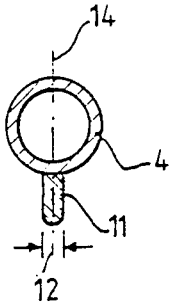
FIG. 3 is a transverse sectional view of the applicator of FIG. 2.

Referring to the drawings, reference numeral 1 denotes a work stand which is supported on one side by a support 2. A crease receiving groove 3 is provided on the work stand, the width and depth of which being determined by conditions such as the thickness of the textile fabric, as well as the thickness and depth of the crease to be produced. 4 is the main body of the applicator which is hollow and provides a reservoir for crease setting composition. A nozzle 5 is mounted on one end of the applicator body, while a compressed air supplying inlet tube 6 is mounted on the other end of the applicator body 4. The air is compressed by a compressor 7 and sent through a filter and regulator 8, to bear against a piston 10 in the applicator 4 via a pressure controller 9. Thus the composition in the cylinder is acted on by the piston and forced through the nozzle 5. A fin-like guide plate 11 is mounted on the lower surface of the applicator body 4. The width 12 of the plate 11 at its lower edge corresponds to the crease to be set in the fabric, and its length 13 corresponds to approximately half the length of the body 4. This plate is set on the axial line 14 drawn in the longitudinal direction of the applicator and passing through the nozzle 5. The plate 11 is used to guide the applicator correctly and smoothly along the crease line in the fabric. The crease line is already formed by conventional means, such as pressing, before using the applicator which applies composition to set the crease and render it 'permanent'. Thus the initial pressing and application of composition must both be extremely accurate, since once the composition has cured the crease is difficult to remove.

To form a crease using the applicator, the textile fabric or garment bearing a pressed-in crease is fitted correctly into the groove 3, for example as described in UK Pat. No. 1580192, then the plate 11 is placed so that it fits into the groove 3 in the work stand and therefore the crease line of the fabric or garment and a switch 15 on the applicator body 4 is turned on to start the compressor 7. Compressed air is then sent through the compressed air-supplying tube 6 to press against the piston 10, which forces the composition out of the nozzle 5 to apply a line of composition within the preformed crease. When the operation is completed, the switch is turned off to stop the supply of compressed air and release the pressure in the cylinder thus stopping discharge of compositions.

The dimensions of the plate 11 are such as to enable a predetermined gap to be maintained between the nozzle 5 and the surface of the textile fabric or garment, and it fits into the crease line within the groove 3 thereby both maintaining the textile fabric or garment in place in the groove in the work stand and guiding the nozzle 5. In addition, as the applicator body 4 moves along the crease, the height of the nozzle set at the beginning of the operation is also maintained without change, thus the application of the composition is done evenly. The applicator can also slide along the groove 3, in the work stand without jumping out of it, because the crease forming plate is sufficiently long to provide positive guidance. In a conventional applicator, a projection or peg is used to guide the applicator as it moves. That projection, however, may come out of the groove, inconveniencing the operator. The plate 11 reduces or eliminates such problems, enabling an easy operation.

In a conventional applicator, the quantity of composition forced out is determined by the rotation of a rotary member mounted on the applicator, so that the contact pressure of the rotary member must be kept up, which is difficult with viscous compositions and light weight fabrics. The applicator in accordance with this invention provides an easy operation and a simple mechanism, and enables the steady and efficient setting of creases in lightweight materials to be carried out.

The crease setting composition employed with the device of the invention is preferably a polyurethane resin which skins-over quickly on exposure to air. The latter property prevents strike-through of composition even when it is used on lightweight fabrics. A latex or a silicone rubber may also be used.

While compressed air has been referred to throughout the above it will be apparent that any compressed fluid could be employed to expel the composition, compressed air being possibly the cheapest and most convenient.

Figure 4:
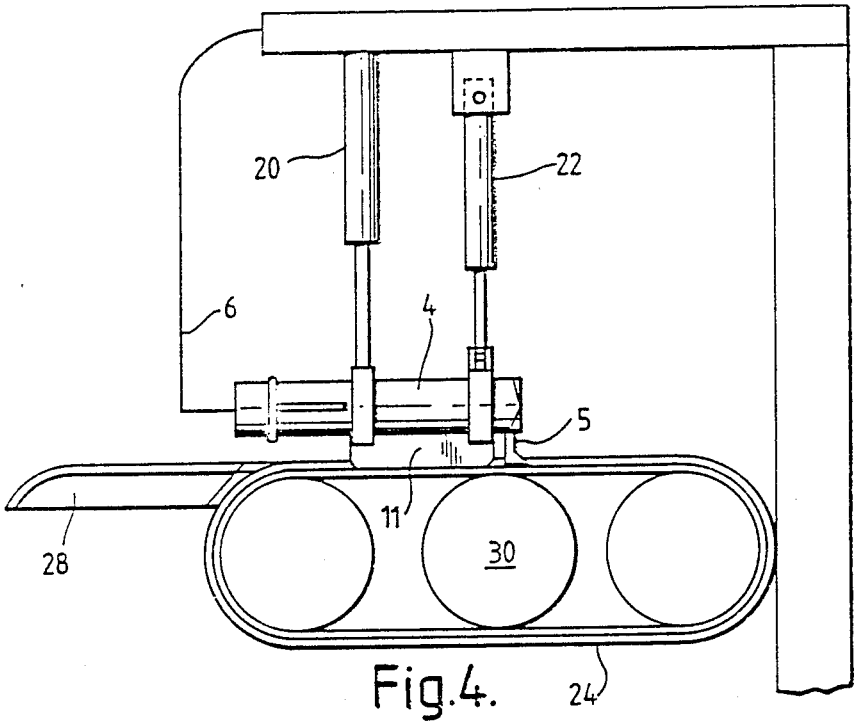
FIG. 4 is an elevational view of another embodiment mounted for automatic operation.
Figure 5:
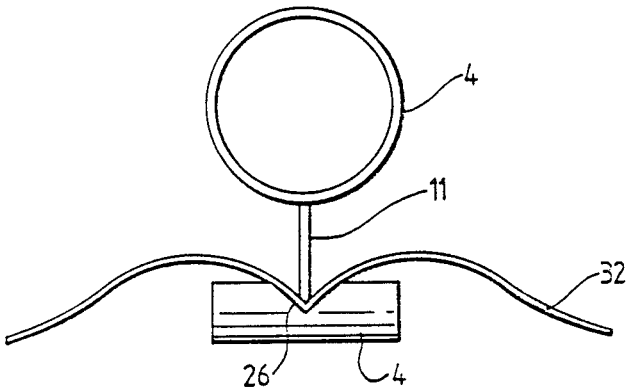
FIG. 5 is an end view corresponding to FIG. 4.

Referring now to FIGS. 4 and 5 and using like numbers to denote like parts, the applicator 4 is mounted on two pneumatic cylinders 20, 22 above an endless belt conveyor 24 having a v-groove 26 therein. A v-grooved guide 28 is provided adjacent the belt 24 which is mounted on rollers 30 one of which is driven.

In use garment (e.g. skirt or trouser) panels 32 to be crease set are fed via the guide 28 to the conveyor 24 with the applicator 24 raised by the cylinders 20, 22, and placed with its leading edge immediately below the nozzle 5. The cylinder 22 is then actuated to lower the nozzle 5 into the crease line; then the other cylinder 20 is actuated to place the plate 11 in the crease line. The roller drive motor is then started simultaneously with applying pressure via the air line 6 so as to move the panel past the nozzle and expel composition into the crease line. Using air cylinders 20, 22 the pressure and location of the guide plate 11 and nozzle 5 can be accurately and consistently controlled without operator skill, both speeding up the operation and improving the quality of the product. The applicator 4 being placed in the operating position urges the garment or panel being treated into contact with the conveyor belt 24, which preferably has a tacky or high-friction surface, thereby ensuring that the belt carries it past the applicator nozzle. Resilient mountings may be provided on the cylinders to give improved accuracy and adjustability of loading on the guide 11. More than one unit may be provided in a predetermined spaced relationship to treat simultaneously multiple crease lines in a garment or panel.

Figure 6:
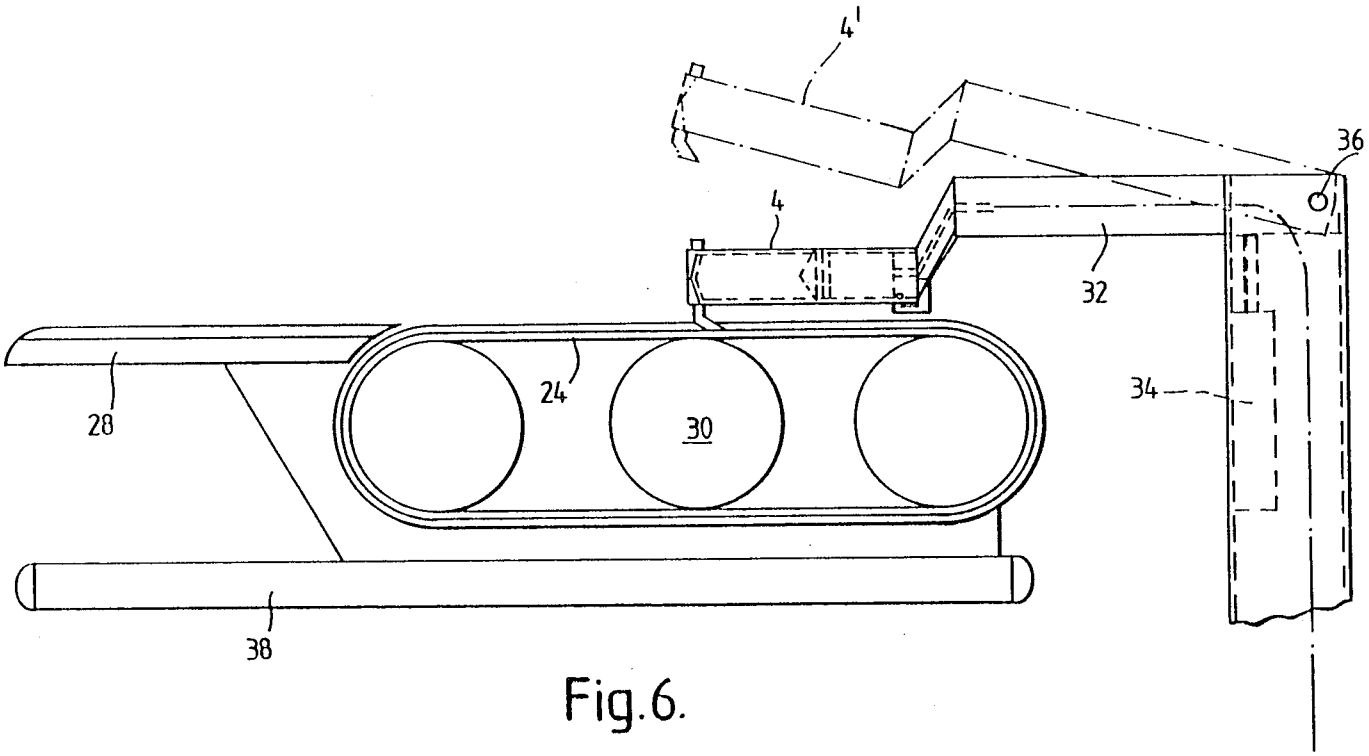
FIG. 6 is a side elevation of a further embodiment.

FIG. 6 depicts a variation on the embodiment of FIGS. 4 and 5 in which the applicator 4 is mounted on an arm 32 controlled by a pneumatic cylinder 34 and pivitally mounted at 36. It operates in a similar manner to the embodiment described above other than the applicator 4 is lifted by the arm 32 to the position shown at 4 to allow insertion and removal of the articles to be treated. By making the guide, belt and roller arrangement free-standing and clear of the table-top 38, the apparatus can accomodate trouser legs for the formation of durable creasas therein. The drive to the belt, lifting/lovering of the arm and application of pressure to the applicator 4 may all be synchronised either by timers, suitably placed sensors or the even the operation.

The quantity of composition discharged may be controlled by altering the air pressure applied, and this is easily regulated according to fabric weight by the operator. The use of an elongate guide pin or plate 11 puts little pressure on the fabric, unlike the rotary member of the above-referred to device, and thus knitted or stretch fabrics can be treated.

We claim:

1. An applicator for a crease setting viscous composition suitable for setting a crease in fabric material, which comprises an applicator body having a nozzle means at one end thereof and an inlet means at the other end thereof, said nozzle means being arranged for evenly applying the crease setting viscous composition generally in the form of a deposited line into and along a preformed crease line of the fabric material by delivering and distributing said composition linearly therealong, said inlet means being arranged for controlled applying of compressed air for forcing said composition out of said nozzle means at a correspondingly controlled delivery rate, said compressed air entering at said inlet means being the sole driving force for forcing said composition out of said nozzle means, and guidance means mounted beneath the applicator body in fixed relation to said nozzle means and adapted, in use, to depend into and move relatively longitudinally with respect to the preformed crease line so as to guide said nozzle means relative to the preformed crease line to cause said nozzle means to deliver and distribute such a deposited line of said composition accurately into and along the preformed crease line during the relative longitudinal movement between the guidance means and the preformed crease line of the fabric material.

2. Applicator of claim 1 wherein the guidance means comprises a fin-like plate.

3. Applicator of claim 2 wherein the plate is of a prolonged length corresponding to a substantial portion of the applicator body.

4. Applicator of claim 2 or 3 wherein the plate is of a width at its lower edge corresponding to the crease to be set.

5. Applicator of claim 3 wherein the plate is aligned with the longitudinal axis passing through the nozzle means.

6. Applicator of claim 1 wherein a switch is provided on the applicator body to enable an operator to control the supply of compressed air.

7. Applicator of claim 1 wherein the guidance means, in use, maintains the applicator body, and hence the nozzle means, at a predetermined distance from the preformed crease line.

8. Applicator of claim 1 wherein the applicator body comprises a reservoir filled with said composition and in flow communication with said nozzle means.

9. Applicator of claim 8 wherein the reservoir includes movable means for maintaining the compressed air out of direct contact with said composition in the reservoir.

10. Applicator of claim 9 wherein the movable means comprises a piston arranged in the reservoir for receiving the compressed air operatively thereagainst and movable in response to the air pressure for forcing said composition from the reservoir and out through said nozzle means.

11. Applicator of claim 1 wherein said composition is selected from the group consisting of a latex, a thiskol polyurethane resin, and a silicone rubber.

12. Applicator of claim 1 wherein the applicator body is mounted above a v-groove containing conveyor for carrying a garment panel and capable of being raised away from and being lowered towards the v-groove.

13. Applicator of claim 12 wherein pneumatic cylinders are provided for raising and lowering the applicator body relative to the v-groove of the conveyor.

14. An applicator for crease setting compositions having a viscosity suitable for setting the creases in fabric material, which comprises an applicator body having a nozzle means at one end thereof for applying the crease setting composition into a crease line of the fabric material and an inlet means for applying compressed air at the other end thereof for forcing the composition out of said nozzle means, said compressed air entering at said inlet means being the sole driving force for forcing the composition out of said nozzle means, and guidance means mounted beneath the applicator body adapted, in use, to depend into the crease line so as to guide the applicator nozzle means to cause it to deliver composition accurately into the crease, said applicator being mounted above a v-grooved conveyor for carrying a garment panel and capable of being raised away from and lowered towards the v-groove, and said compressed air being applied in timed relationship with the movement of the conveyor.

15. Applicator of claim 14 wherein the raising and lowering is carried out by pneumatic cylinders.

* * * * *